US011969109B2

(12) United States Patent
Limbrey

(10) Patent No.: US 11,969,109 B2
(45) Date of Patent: Apr. 30, 2024

(54) DRINKS STIRRER

(71) Applicant: D.J. LIMBREY DISTILLING COMPANY LIMITED, Chislehurst (GB)

(72) Inventor: Dominic Limbrey, Chislehurst (GB)

(73) Assignee: D.J. LIMBREY DISTILLING COMPANY LIMITED, Kent (GB)

( * ) Notice: Subject to any disclaimer, the term of this patent is extended or adjusted under 35 U.S.C. 154(b) by 850 days.

(21) Appl. No.: 17/049,469

(22) PCT Filed: Apr. 29, 2019

(86) PCT No.: PCT/GB2019/051177

§ 371 (c)(1),
(2) Date: Oct. 21, 2020

(87) PCT Pub. No.: WO2019/215424

PCT Pub. Date: Nov. 14, 2019

(65) Prior Publication Data

US 2021/0251406 A1 Aug. 19, 2021

(30) Foreign Application Priority Data

May 10, 2018 (GB) ..... 1807587

(51) Int. Cl.
*A47G 19/16* (2006.01)
*B65D 85/812* (2006.01)

(52) U.S. Cl.
CPC ..... *A47G 19/16* (2013.01); *B65D 85/812* (2013.01)

(58) Field of Classification Search
CPC ..... A47G 19/16; A47G 21/04; A47G 21/004; A47G 21/181; B65D 85/812; B01F 3/0857; A47J 31/20; A47J 31/60; A47J 31/4403; A47J 31/3623; A47J 31/407
USPC ..... D7/300.2, 305, 376, 643, 653, 688; D9/436, 716; D24/108, 110.5, 112;
(Continued)

(56) References Cited

U.S. PATENT DOCUMENTS

D181,860 S * 1/1958 Krenchel
D330,481 S * 10/1992 Green
D440,810 S 4/2001 Olson
(Continued)

FOREIGN PATENT DOCUMENTS

DE 323436 * 1/1930 ..... A47G 19/16
DE 202 07 528 U1 10/2002
(Continued)

OTHER PUBLICATIONS

PCT/GB2019/051177 International Search Report and Written Opinion, dated Jul. 29, 2019.

*Primary Examiner* — Phuong T Nguyen
(74) *Attorney, Agent, or Firm* — Lippes Mathias LLP

(57) ABSTRACT

There is provided a drinks stirrer (10) for stirring an infusion pouch within a drink. The infusion pouch comprises a pouch soring an infusion media, a tag for holding the infusion bag, and a string connecting the pouch to the tag. The drinks stirrer (10) comprises a proximal end (14) having a retainer device (32, 34) for retaining the tag to the proximal end, and a distal end (12) having a scoop (20) for holding the pouch. The scoop (20) comprises a slot (24) for receiving the string to constrain the pouch to adjacent the scoop. A drinks apparatus comprising the infusion pouch and the drinks stirrer is also provided.

17 Claims, 2 Drawing Sheets

(58) Field of Classification Search
USPC ..... D25/119, 15, 132; 99/295, 323, 494, 99/495, 287; 426/431, 110, 115, 79, 82
See application file for complete search history.

(56) References Cited

U.S. PATENT DOCUMENTS

| | | | |
|---|---|---|---|
| D506,633 | S | 6/2005 | Dick-Read |
| D539,619 | S | 4/2007 | Oura |
| D548,020 | S | 8/2007 | Verde |
| D658,923 | S | 5/2012 | Tankel |
| D696,084 | S | 12/2013 | Frei |
| D862,959 | S | 10/2019 | Kay et al. |
| 2008/0128529 | A1 | 6/2008 | Fernandez |
| 2012/0328741 | A1 | 12/2012 | Hannah et al. |
| 2018/0162156 | A1 | 6/2018 | Post et al. |
| 2019/0254452 | A1 | 8/2019 | Merritt |

FOREIGN PATENT DOCUMENTS

| | | |
|---|---|---|
| GB | 323436 | 1/1930 |
| JP | S49 39788 | 4/1975 |

* cited by examiner

DRINKS STIRRER

FIELD OF THE INVENTION

The present invention relates to a drinks stirrer, and more particularly a drinks stirrer for stirring an infusion pouch within a drink.

BACKGROUND OF THE INVENTION

It is known to use infusion pouches when making drinks, to add flavour and/or scent to the drink. Common types of infusion pouches include teabags, where high temperature is used to facilitate infusion from the tealeaves into the water, however infusion pouches can also be used to add different scents or flavours to cold drinks as well, for example alcoholic drinks. Infusion pouches are also sometimes referred to in the art as infusion pockets.

The infusion pouch may be stirred and/or compressed in the drink with a spoon to hasten the release of scent and/or flavour from the infusion media inside the pouch, and stirring may also be desirable to help mix the drink together with the scent and/or flavour. Once the infusion has had sufficient time to steep in the drink, it is typically removed before the drink is consumed. It is known to provide infusion pouches that have a tag on the end of a string connected to the pouch, to assist removal of the pouch from the container of the drink. But, one of the problems with such strings is that they tend to drag the tag into the drinks container when liquid for the drink is poured into the container.

Another problem is that the pouches may rise to the surface of the drink, limiting the ability of the infusion media in the pouch to infuse into the drink and transfer the desired scents/flavours. This is a common occurrence if the liquid in the drinks container is carbonated, since gas tends to accumulate on the surface of the pouch, and lifts the pouch up and partially out of the drink.

It is therefore an aim of the invention to improve on the known art.

SUMMARY OF THE INVENTION

According to a first aspect of the invention, there is provided a drinks stirrer for stirring an infusion pouch within a drink. The infusion pouch comprises a pouch storing an infusion media, a tag for holding the infusion bag, and a string connecting the pouch to the tag. The drinks stirrer comprises a proximal end having a retainer device for retaining the tag to the proximal end, and a distal end having a scoop for holding the pouch. The scoop comprises a slot for receiving the string to constrain the pouch to adjacent the scoop.

The retainer device of the stirrer prevents the tag of the infusion pouch from being dragged into the drinks container by liquid poured on the string of the infusion pouch, and keeps the tag clean and dry of liquid. The slot in the scoop receives the string at a point close to the pouch, and, because the string is under tension by virtue of the tag retained by the retainer device, the pouch is forced to remain close to the scoop, preventing the pouch from rising to the top of the drink where it would lose its effectiveness. The stirrer can be stirred within the drink, and the string in the slot forces the pouch to follow the motion of the scoop, helping to release scent and/or flavour and stir the scent and/or flavour into the drink.

The slot preferably has a length extending in a direction parallel to a direction from the distal end to the proximal end of the stirrer, so that the string can be easily located in the slot as it passes from the distal end to the proximal end. The slot may comprise an open end through which the string is receivable, and a closed end opposite the open end. Preferably, the width of the slot is greater at the open end of the slot than at the closed end of the slot so that the string is easily received into the open end of the slot, and more tightly constrained at the closed end of the slot. Optionally, the slot may be the only slot of the scoop, and may extend along a central axis of the stirrer, in alignment with a direction from the distal to the proximal end of the scoop.

The drinks stirrer may comprise a shaft that extends from the distal end to the proximal end, with the shaft having a spiraled exterior along the length of the shaft for winding any slack in the string around the spiral. This assists in using infusion pouches with variable length strings, so that the string remains in tension where it passes through the slot to the pouch. Optionally, the shaft may be provided with a clip to help retain the string to the shaft.

The retainer device may comprise a plate for the tag to be retained between the plate and a retainer tab. The retainer tab may be spring biased towards the plate for clipping the tag to the plate, or the retainer tab and the plate may simply form two sides of a cradle in which the tag of the infusion pouch rests. For example, the retainer tab and the plate may be in parallel planes to one another and connected by a joint portion, which may be at an outer edge of the plate shape.

The retainer tab may have a slot adjacent the shaft for the string to exit the retainer tab in the direction of the shaft. The plate can be used as a handle to hold the stirrer, and may be used to display product branding.

The drinks stirrer may comprise a front side where the scoop has a concave shape and a rear side where the scoop has a convex shape. Preferably, the plate has a front side at the front side of the stirrer, which provides a surface which the user can grip with their thumb. The retainer tab is mounted to the plate at a rear side of the plate, opposite from the front side.

In one embodiment, there is provided a drinks stirrer for stirring an infusion pouch within a drink, the drinks stirrer comprising: a proximal end having a retainer device for retaining a tag of the infusion pouch to the proximal end, and a distal end having a scoop for holding a pouch of the infusion pouch, wherein the scoop comprises a slot for receiving a string of the infusion pouch that connects the pouch to the tag, to constrain the pouch to adjacent the scoop. Preferably, the retainer device comprises a retainer tab, and the retainer tab comprises a slot for the string to exit the retainer tab.

According to a second aspect of the invention, there is provided a drinks apparatus comprising an infusion pouch and the drinks stirrer of the first aspect. The tag of the infusion pouch is retained by the retainer device, the pouch is held by the scoop, and the string extends through the slot in the scoop. Preferably, the tag is shaped to fit neatly on the plate and be retained by the retainer tab at the proximal end of the stirrer. For example, the plate may have a same shape as the tag.

DETAILED DESCRIPTION

Embodiments of the invention will now be described by way of non-limiting example only and with reference to the accompanying drawings, in which.

The figures are not to scale, and same or similar reference signs denote same or similar features.

Figure 1:
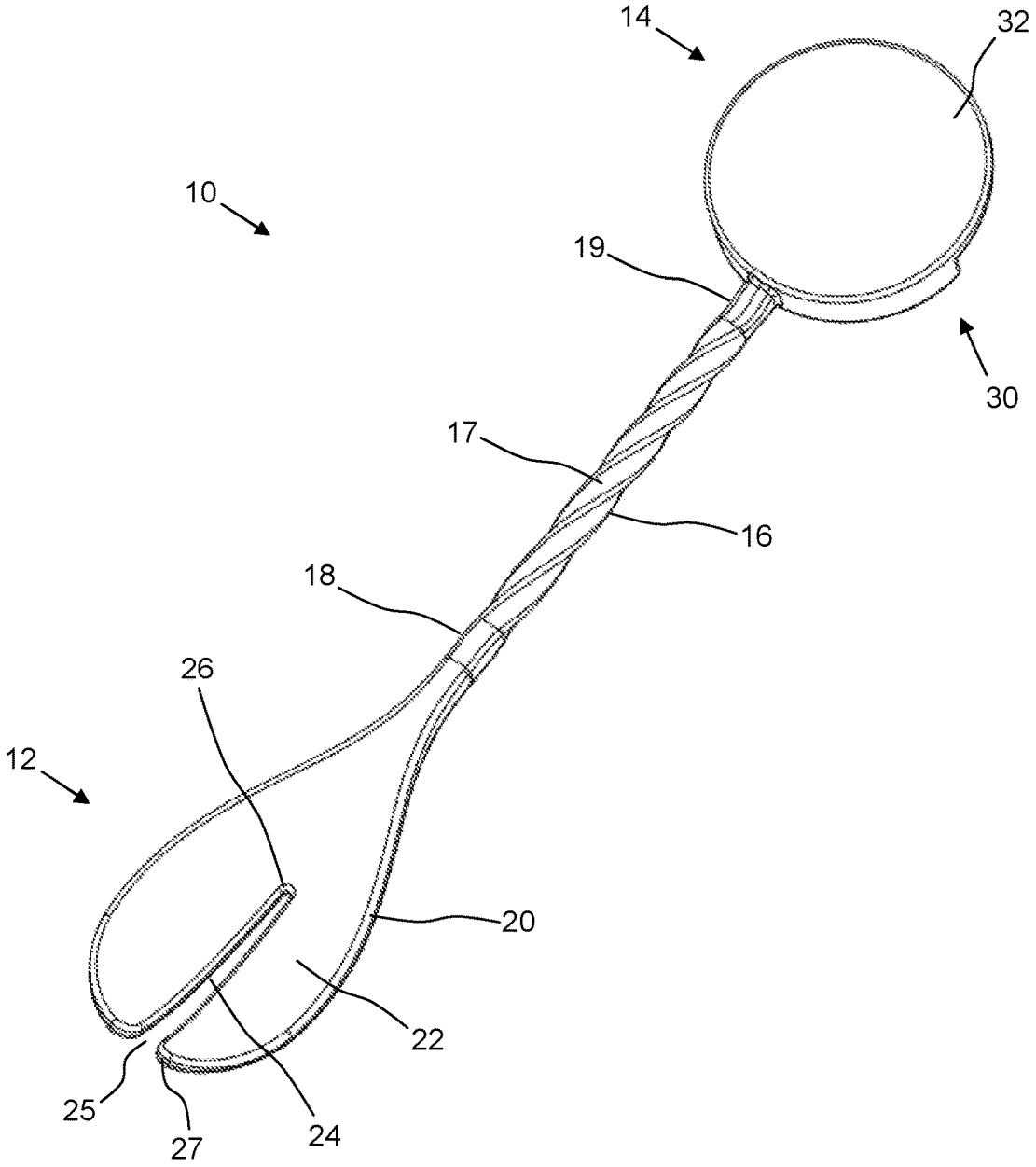
FIG. 1 shows a schematic perspective diagram of a front side of a drinks stirrer according to an embodiment of the invention.

The schematic perspective diagram of FIG. 1 shows a drinks stirrer 10 that comprises a scoop 20 at a distal end 12 of the stirrer and a plate 32 at a proximal end 14 of the stirrer. A shaft 16 extends from the scoop 20 to the plate 32, connecting the scoop and plate to one another.

The shaft 16 comprises a main body portion having a spiral 17 along the length of the body portion, and connecting portions 18 and 19 at opposing ends of the shaft that connect to the scoop 20 and plate 32 respectively. The shaft 16 has a cross-sectional shape with an aspect ratio of approximately 1:1, over a plane parallel to the longitudinal axis 50 (see FIG. 3). Then, the shaft easily cuts through liquid in any direction and presents minimal resistance to the stirring of the drinks stirrer within the drinks container, allowing most of the stirring force applied by the user to be exerted on the scoop 20 where an infusion media in a pouch may be held.

The drinks stirrer 10 is integrally formed in one piece from stainless steel, although other materials such as plastics could be used in alternate embodiments, and the drinks stirrer could be manufactured from separate components that are joined together with one another if desired.

The plate 32 forms a flat surface for a user of the stirrer to hold, for example using their thumb, and may display drinks product branding to the user. In this embodiment the plate is entirely planar, although a curved plate could alternatively be used, or be omitted for another type of handle. The plate may have holes/apertures cut into it for decorative purposes.

Figure 4:
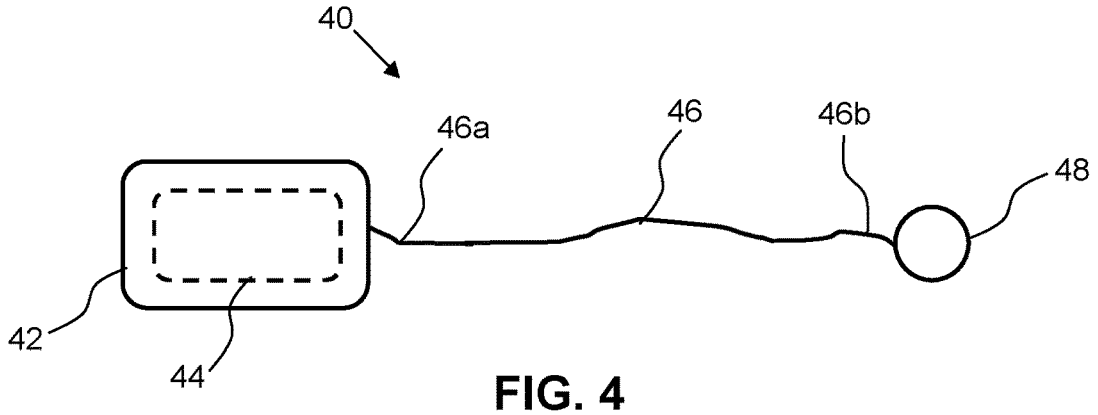
FIG. 4 shows a schematic diagram of an infusion pouch for use with the drinks stirrer of FIG. 1.

The scoop 20 comprises a concave surface 22 for holding a pouch 42 of an infusion pouch 40 (shown in FIG. 4). The scoop has a single slot 24 which extends all the way through the thickness of the scoop, and is aligned with the same direction as the direction from the scoop to the plate 32. The slot extends from a curved leading edge 23 of the scoop at an open end 25, towards the back of the scoop, up to a closed end 26. The slot 24 is wider at the open end 25 of the slot than at the closed end 26 of the slot. The slot 24 preferably extends for at least half the length of the concave surface of the scoop, and in the illustrated embodiment the slot 24 extends substantially 75% of the length of the concave surface of the scoop, from the curved leading edge 27 of the scoop towards the proximal end 14 of the stirrer, in alignment with the central longitudinal axis 50 (see FIG. 3) of the scoop.

Figure 2:
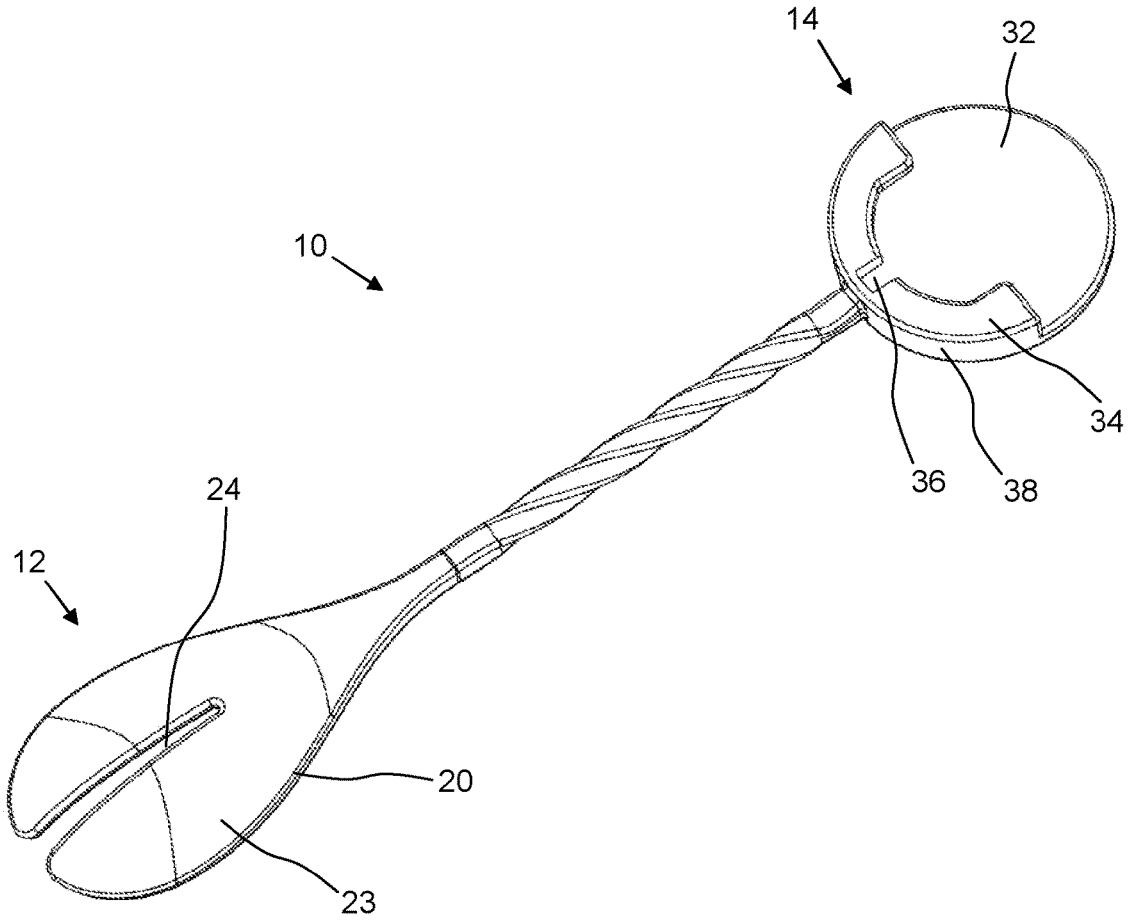
FIG. 2 shows a schematic perspective diagram of a rear side of the drinks stirrer of FIG. 1.

FIG. 1 shows the front side of the stirrer 10 having the concave surface 22, and the back side of the stirrer 10 is shown in FIG. 2, where the scoop has a convex surface 23 corresponding to the concave surface on the front of the scoop.

At the proximal end 14 of the scoop, a retainer tab 34 can be seen at the back side of the stirrer. In this particular embodiment the plate 32 is a circular plate, and the retainer tab 34 and the plate 32 extend in parallel planes to one another. The retainer tab 34 is joined to the plate 34 by two joint portions 38 on opposite sides of the shaft to one another. The joint portions 38 extend from the plate 32 to the retainer tab 34 at the peripheral edge of the plate 32 in the region where the plate 32 joins to the shaft 16.

Figure 3:
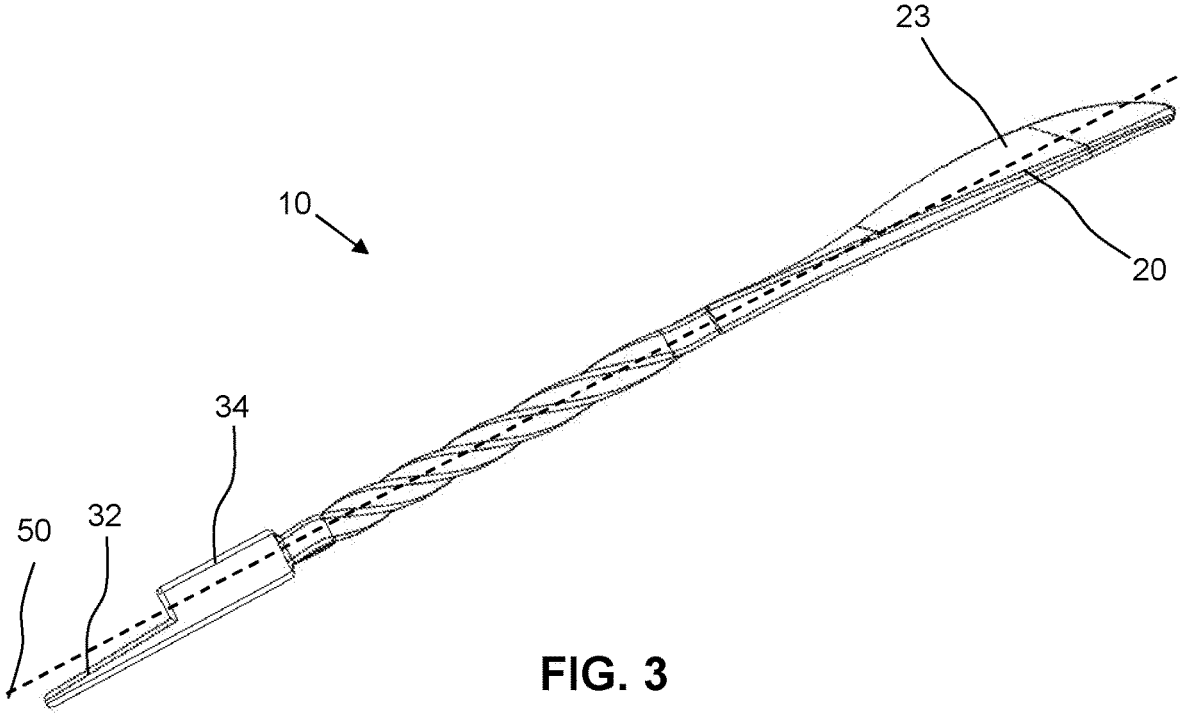
FIG. 3 shows a schematic side diagram of the drinks stirrer of FIG. 1.

The retainer tab 34 comprises a slot 36 that extends along the longitudinal axis 50 (see FIG. 3). The plate 32, retainer tab 34, and joint portions 38 together form a cradle for holding a tag 48 of the infusion pouch 40 (refer to FIG. 4). As shown in FIG. 4, the infusion pouch comprises the pouch 42 and the tag 48, joined to one another by a string 46. The string 46 has a first end portion **46*a* connected to the pouch 42, and a second end portion 46*b* connected to the tag 48. The pouch 42 holds an infusion media 44, for adding scent & flavouring to drinks. Typically, the pouch 42 is formed of a paper material with a multitude of small holes through which drinks can flow, and the tag 48** is formed of card, but other materials could be used in alternate embodiments.

In use, the pouch 42 is placed on the concave surface 22 of the spoon 20, and the first end **46*a* of the string is passed through the slot 24 (see FIG. 1) to the back side of the spoon. The string 46 is wound around the spiral 17 of the shaft 16 until the second end 46*a* of the string can be passed under tension through the slot 36 (see FIG. 2), and the tag 48 placed into the retainer device of the stirrer, by sliding the tag 48 between the plate 32 and the retainer tab 34, until it reaches the joint portions 38. Then, the stirrer 10 with the infusion pouch 40 can be used to stir a drink and add scent/flavour to the drink from the infusion media 44. The tag 48 is the same size and shape as the plate 32** for convenience.

The scoop 20 can be used to stir and/or compress the pouch 42 inside the drinks container, and the pouch 42 cannot move far from the scoop 20 due to the string in the slots 24 and 36. The width of the slot 24 adjacent the closed end 26 is sized to grip the string 46 and restrain movement of the string through the slot 24, to help keep the pouch close to the scoop. Once the drink has been infused to the user's satisfaction, the stirrer can be withdrawn from the drinks container, pulling the infusion pouch 40 out with it, and allowing the infusion pouch 40 to be easily disposed.

Many other variations of the described embodiments falling within the scope of the invention will be apparent to those skilled in the art. For example, the plate 32, retainer tab 34, and joint portions 38 could easily be replaced with other types of retainer device such as a clip in alternate embodiments.

The invention claimed is:

1. A drinks stirrer for stirring an infusion pouch within a drink, the infusion pouch comprising a pouch storing an associated infusion media, a tag for holding the infusion pouch, and a string connecting the pouch to the tag, wherein the drinks stirrer comprises a proximal end having a retainer device for retaining the tag to the proximal end, a distal end having a scoop for holding the pouch, and a shaft that extends from the distal end to the proximal end, wherein the scoop comprises a slot for receiving the string to constrain the pouch to adjacent the scoop, wherein the retainer device comprises a retainer tab, and the retainer tab comprises a slot for the string to exit the retainer tab via the slot of the retainer tab, wherein the slot of the retainer tab is immediately adjacent the shaft.

2. The drinks stirrer of claim 1, wherein the slot has a length extending in a direction parallel to a direction from the distal end to the proximal end.

3. The drinks stirrer of claim 1, wherein the slot comprises an open end through which the string is receivable, and a closed end opposite the open end, and wherein a width of the slot is greater at the open end of the slot than at the closed end of the slot.

4. The drinks stirrer of claim 1, wherein the scoop has a concave shape and the slot extends through the concave shape.

5. The drinks stirrer of claim 1, wherein a cross sectional shape of the shaft has an aspect ratio within the range of 1:2 to 2:1.

6. The drinks stirrer of claim 1, wherein the shaft has a spiraled exterior along a length of the shaft for winding any slack in the string around the spiral.

7. The drinks stirrer of claim 6, wherein the shaft has a clip for retaining the string to the shaft.

8. The drinks stirrer of claim 1, wherein the slot of the scoop is the only slot in the scoop.

9. A drinks apparatus comprising an infusion pouch and the drinks stirrer of claim 1, wherein the infusion pouch comprises a pouch storing an associated infusion media, a tag for holding the infusion pouch, and a string connecting the pouch to the tag, wherein the tag is retained by the retainer device, the pouch is held by the scoop, and the string extends through the slot.

10. A drinks stirrer for stirring an infusion pouch within a drink, the infusion pouch comprising a pouch storing an associated infusion media, a tag for holding the infusion pouch, and a string connecting the pouch to the tag, wherein the drinks stirrer comprises a proximal end having a retainer device for retaining the tag to the proximal end, and a distal end having a scoop for holding the pouch, wherein the scoop comprises a slot for receiving the string to constrain the pouch to adjacent the scoop, wherein the retainer device comprises a retainer tab, and the retainer tab comprises a slot for the string to exit the retainer tab via the slot of the retainer tab, and wherein the retainer device further comprises a plate for the tag to be retained between the plate and the retainer tab.

11. The drinks stirrer of claim 1, wherein the retainer device further comprises a plate for the tag to be retained between the plate and the retainer tab.

12. The drinks stirrer of claim 11, wherein the plate and the retainer tab extend parallel to one another and are connected by a joint portion, thereby forming a cradle for the tag.

13. The drinks stirrer of claim 12, wherein the plate is entirely planar.

14. The drinks stirrer of claim 11, wherein the plate is entirely planar.

15. The drinks apparatus of claim 9, wherein the drinks stirrer is according to claim 10, and wherein the plate has a same shape as the tag.

16. The drinks stirrer of claim 10, wherein the plate is entirely planar.

17. A drinks stirrer for stirring an infusion pouch within a drink, the infusion pouch comprising a pouch storing an associated infusion media, a tag for holding the infusion pouch, and a string connecting the pouch to the tag, wherein the drinks stirrer comprises a proximal end having a retainer device for retaining the tag to the proximal end, and a distal end having a scoop for holding the pouch, wherein the scoop comprises a slot for receiving the string to constrain the pouch to adjacent the scoop, wherein the retainer device comprises a retainer tab having a slot for the string to exit the retainer tab via the slot, wherein the retainer device further comprises a plate for the tag to be retained between the plate and the retainer tab, wherein the plate and the retainer tab extend parallel to one another and are connected by a joint portion, thereby forming a cradle for the tag.

* * * * *